US008610309B2

(12) United States Patent
Kragelund

(10) Patent No.: US 8,610,309 B2
(45) Date of Patent: Dec. 17, 2013

(54) SENSOR FOR SWITCHING A PUMP ON AND/OR OFF

(75) Inventor: Klaus Vestergaard Kragelund, Risskov (DK)

(73) Assignee: Grundfos Management a/s, Bjerringbro (DK)

( * ) Notice: Subject to any disclaimer, the term of this patent is extended or adjusted under 35 U.S.C. 154(b) by 569 days.

(21) Appl. No.: 12/936,933

(22) PCT Filed: Mar. 13, 2009

(86) PCT No.: PCT/EP2009/001826

§ 371 (c)(1),
(2), (4) Date: Oct. 8, 2010

(87) PCT Pub. No.: WO2009/124635

PCT Pub. Date: Oct. 15, 2009

(65) Prior Publication Data

US 2011/0027104 A1 Feb. 3, 2011

(30) Foreign Application Priority Data

Apr. 9, 2008 (EP) ..... 08007006

(51) Int. Cl.
*H01L 47/02* (2006.01)

(52) U.S. Cl.
USPC ..... 307/99

(58) Field of Classification Search
USPC ..... 307/99
See application file for complete search history.

(56) References Cited

U.S. PATENT DOCUMENTS

| | | | | |
|---|---|---|---|---|
| 4,437,811 | A | 3/1984 | Iwata et al. | |
| 2003/0136189 | A1 * | 7/2003 | Lauman et al. | 73/304 C |
| 2006/0039802 | A1 | 2/2006 | Gurega | |

FOREIGN PATENT DOCUMENTS

| | | | |
|---|---|---|---|
| CN | 1321221 | A | 11/2001 |
| EP | 1 138 951 | A1 | 10/2001 |
| JP | 2006-070729 | A | 3/2006 |
| WO | 0118395 | A1 | 3/2001 |

OTHER PUBLICATIONS

Int'l Search Report issued on Apr. 29, 2009 in Int'l Application No. PCT/EP2009/001826.
Office Action issued Mar. 5, 2013 in CN Application No. 200980112828.3.

* cited by examiner

*Primary Examiner* — Robert L. Deberadinis
(74) *Attorney, Agent, or Firm* — Panitch Schwarze Belisario & Nadel LLP

(57) ABSTRACT

The invention relates to a sensor for switching a pump on and/or off, with at least one first and a second electrode, which form a capacitance which may be influenced by way of the fluid to be delivered, and with evaluation electronics connected to the electrodes, wherein the evaluation electronics has a voltage supply which is connected to the first electrode and which is designed for providing short voltage pulses for charging the first electrode, and comprises an evaluation circuit which is designed in a manner such that during a voltage increase on charging and/or a voltage reduction on discharging the electrode, it detects the current between the electrodes and emits a switch-on signal and/or switch-off signal depending on the detected current, as well as to a pump with such a sensor.

15 Claims, 12 Drawing Sheets

SENSOR FOR SWITCHING A PUMP ON AND/OR OFF

CROSS-REFERENCE TO RELATED APPLICATIONS

This application is a Section 371 of International Application No. PCT/EP2009/001826, filed Mar. 13, 2009, which was published in the German language on Oct. 15, 2009, under International Publication No. WO 2009/124635 A1 and the disclosure of which is incorporated herein by reference.

BACKGROUND OF THE INVENTION

The invention relates to a sensor for switching a pump, in particular a submersible pump or basement pump, on and/or off.

Submersible pumps such as waste water pumps for example, often comprise sensors or switches, which switch on the pump on exceeding a predefined water level, and switch the pump off again when falling short of a second water level, which as a rule is lower. For example mechanical float switches are known for this. However, with these, there is the danger of them becoming blocked in their movement, which leads to faults on switching the pump on and/or off.

Moreover, electronic sensors such as capacitive sensors for switching the pump on and/or off, in dependence on a fluid level or water level, are known. A high-frequency oscillator, which is connected to the water, is provided with these known capacitive sensors. The change of the capacitance formed by the water is thereby determined by way of the electricity consumption of the oscillator. These electronic circuits require a high-frequency signal generator and a very sensitive circuit for detecting the electricity consumption. This renders such switches complicated and expensive.

BRIEF SUMMARY OF THE INVENTION

It is therefore the object of the invention, to provide an improved sensor for switching a pump on and/or off, which functions according to a capacitive measurement principle, but is simpler and less expensive to construct.

The sensor according to the invention is provided for switching a pump on and/or off, in particular a submersible pump or a basement pump, as is applied for example with the drainage of basements. The sensor operates according to the capacitive measurement principle, and for this comprises a first and second electrode, which form a capacitor. The capacitor is arranged such that its capacitance is influenced by the fluid to be delivered. That is the capacitance changes depending on the height of the fluid level or simply the level. Thereby, the two extremes are defined by the condition, in which no water is located between the electrodes, and the condition, with which both electrodes lie completely in the fluid, i.e. preferably lie below the water level. Moreover, an electronic circuit is provided, which is connected to the electrodes and which serves for the signal evaluation of the changing capacitance between the electrodes, in order to generate a switch-on and/or switch-off signal for the pump.

According to the invention, the electronic circuit comprises a voltage supply which is connected to a first electrode. This voltage supply is envisaged to electrically charge the first electrode with respect to the surroundings and the second electrode. For this, the voltage supply is designed such that it may emit short voltage pulses for charging the first electrode. Preferably, the electronic circuit is designed such that a multiplicity of voltage pulses of the electrode, for example between three and forty pulses, further preferably between five and twenty pulses, are emitted, in order to charge the first electrode. An electrolysis between the electrodes and a wear of the electrodes is prevented by way of these short voltage pulses. Preferably, a very short switch-on time <1% of the total charging time, is selected.

According to the invention, the electronic circuit further comprises an evaluation circuit which is designed to detect and evaluate capacitance changes between the electrodes, in order to produce a switch-on signal and/or switch-off signal for the pump. This evaluation circuit is designed such that it detects the current between the electrodes during a voltage increase when charging, and/or a voltage reduction on discharging the electrode, and emits a switch-on signal and/or switch-off signal, depending on the detected current. The current flowing between the electrodes on charging or discharging is proportional to the capacitance between the electrodes. Inasmuch as this is concerned, one may ascertain by way of the current as to whether the electrodes lie in water or not.

The electronic circuit according to the invention is significantly simpler and less expensive to construct than known capacitive sensors, since one may make do without a high-frequency signal generator. The detection of the current on charging and/or discharging is quite simple to accomplish, and only one pulse generator for producing the voltage pulses is necessary for the charging, not however a signal generator which produces a certain high-frequency signal.

Preferably, the electronic circuit is designed in a manner such that the temporal signal course of the voltage U has a predefined gradient at least in one section, on charging the electrode and/or on discharging the electrode. That is dU/dt is known in the region of this defined gradient. With the knowledge of this gradient, one may determine the capacitance C when detecting or measuring the discharge current $I_C$, according to the formula $$I_C = C \cdot \frac{dU}{dt}.$$

The capacitance is dependent on whether fluid is located between the electrodes or not. Thus in this manner, one may determine the capacitance by way of current measurement with the knowledge of the charging curve or discharging curve.

It is further preferable for the predefined gradient to be selected steeply, preferably steeper than 5 V/μs. The influence of the electrical resistance between the electrodes, on the charging or discharging procedure, is reduced or eliminated by way of such a rapid charging or discharging. With a slower charging or discharging, a current which causes a discharging would flow between the electrodes, if water were located between the electrodes. In this condition, thus no defined charging curve or discharging curve with a defined gradient could be achieved. The discharge of the electrodes via the fluid located between the electrodes is largely minimized or ruled out by way of the very rapid charging or preferably discharging via suitable components in the electronic circuit. In order to be able to discharge the charged electrode in a defined manner, the electronic circuit preferably comprises a discharge device which effects the discharging procedure with the mentioned defined gradient. The gradient of the voltage course on charging or the negative gradient on discharging is further preferably >100 V/μs, in particular >500 V/μs.

According to a preferred design, the electronic circuit is designed in a manner such that a cyclically repeating charging and discharging of the electrode takes place with the detection of the current on charging and/or discharging. In this manner, a continuous monitoring process is carried out, in order to ascertain whether fluid is located between the electrodes or not. In this manner, the capacitive sensor may be applied as a sensor for switching on a pump. One may also use such a sensor for switching off such a pump, wherein the switch-off point in time may be recognized by way of the fact that less or no fluid is present between the electrodes, i.e. the pump has pumped the surroundings empty or dry, to the necessary level.

Further preferably, the electronic circuit is designed in a manner such that the electrode is firstly charged by several voltage pulses of the voltage supply, and subsequently discharged, wherein the evaluation circuit detects the current during the discharging, and emits a switch-on signal and/or switch-off signal, depending on the detected current. Thereby, the detected current is representative or proportional to the capacitance between the electrodes, which in turn depends on whether fluid is located between the electrodes or not. Preferably, thus the current measurement and thereby the determining of capacitance takes place during a defined discharging procedure. This discharging may be initiated and carried out by a discharge device present in the electronic circuit, so that a discharging procedure may be carried out with a very steep discharge curve, as has been previously described. Particularly preferably, this discharge curve is linear in the region, in which the current measurement is carried out. As described, an electrolysis in the fluid is prevented by way of the charging of the electrode by way of very short voltage pulses. The influence of the electrical resistance is reduced or ruled out by way of the rapid discharging procedure.

One may also compute the capacitance of the capacitor formed by the electrodes, by way of current measurement on discharging. If the fluid to be delivered is located between the electrodes, the capacitance is significantly larger than if no fluid, i.e. air, is located between the electrodes. In the case of water as a fluid, the capacitance is about eighty times larger than with air, on account of the larger relative permittivity of water ($\epsilon_R$=80) compared to air ($\epsilon_R$=1). The arrangement of the electrodes determines whether the switch-on point and/or switch-off point of the sensor is determined by it. Basically, one sensor is sufficient, in order to determine the switch-on point and switch-off point. Thus, a switch-on signal for switching on the pump may be emitted when fluid between the electrodes is detected by the evaluation device, on account of the larger capacitance. If a lower capacitance is again detected by the evaluation circuit on account of the lower discharge current, then one may conclude that fluid is no longer located between the electrodes, and a switch-off signal is emitted for switching off the pump. Alternatively, it is possible to arrange two sensors at a different vertical level and to switch on the pump by way of a switch-on signal of the upper sensor, wherein this switch-on signal is produced by the evaluation circuit, when water is detected by the electrodes of this upper sensor. The pump may then be switched off by a switch-off signal of the second lower sensor, which is emitted by its evaluation device when no water, i.e. air, is detected between the electrodes.

According to a further preferred embodiment, the electronic circuit is designed in a manner such that the evaluation circuit additionally determines the electrical resistance between the two electrodes and emits a switch-on signal and/or switch-off signal depending on the detected current and the resistance. Since, in the case that a conductive fluid such as water is located between the electrodes, these electrodes form no ideal capacitance, a larger measurement accuracy may be achieved by way of additionally taking into account the electrical resistance of the medium, i.e. of the fluid.

The voltage supply preferably comprises a voltage source with an electrical resistance which is connected in series after this and with a capacitance which is connected in parallel to this. The circuit may be made short-circuit-proof by way of this arrangement.

The voltage supply preferably comprises a signal generator for producing a charging voltage and/or discharge voltage with a defined signal course. This signal generator when charging and particularly preferably when discharging, produces the defined voltage curve which is very steep at least in sections. Thus the capacitance formed by the electrodes is discharged with a defined voltage course over time. This voltage course on discharging is set by the signal generator.

The subject matter of the invention is further a pump for delivering a fluid, with an electrical drive motor and with a control device for switching the drive motor on and off. According to the invention, the pump is designed such that its control device comprises at least one sensor according to the previous description, which serves for switching the pump on and/or off in dependence on the fluid level. The sensor, which in cooperation with the evaluation device produces the switch-on signal, is arranged at a vertical level which is the switch-on level. That is, the pump is switched on when the fluid level reaches the switch-on level. The sensor is arranged such that at this fluid level, its capacitance is changed such that this is determined by the evaluation device by way of the discharge current, and a switch-on signal is accordingly emitted. For switching off, either the same or a further sensor is arranged at a level, at which, when fallen short of by the fluid level, the pump is to be switched off again. Thereby, the switching-off is effected when the capacitance changes such that it corresponds to the capacitance of air between the electrodes. However, it is not compellingly necessary for the switching-off of the pump to be likewise initiated by such a sensor according to the preceding description.

Preferably, one of the electrodes is formed by the housing of the pump, and the second electrode is arranged insulated with respect to the housing. This particularly lends itself if the pump housing is designed of metal. Alternatively, it is also possible to provide two electrodes which are insulated with respect to one another and are distanced to one another, on the outer side of the housing. Preferably, the electrodes have direct contact with the surrounding fluid, i.e. they are not covered by further material layers to the pump outer side.

As described, the at least one sensor is arranged, in order to produce a switch-on signal for the drive motor given a defined fluid level. This sensor is preferably arranged in the vertical upper region of the pump.

According to a preferred embodiment, a switch-off device is provided for the pump, and comprises at least one detection means for detecting at least one electrical parameter of the drive motor, and is designed in a manner such that a dry-running of the pump may be detected on the basis of this electrical parameter and, with a detected dry-running, produces a switch-off signal for the drive motor. The dry running may for example be detected on account of a phase shift in the electrical operating voltage supplied to the drive motor. The drive motor is preferably provided with a frequency converter for rotational speed control. Means or functions of the present frequency converter may be utilized, in order to detect this phase shift and thus the dry-running. However, other parameters such as the electrical current may also serve to detect the dry running. The detection means is then designed accordingly.

According to a further preferred embodiment, a protective electrode is arranged on the pump, which shields the first electrode of the sensor with respect to electrical components in the inside of the pump. For this, this protective electrode is arranged lying further inwards in or on the pump, behind the first electrode, so that the protective electrode is situated between electronic components in the inside of the housing and the first electrode.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

The invention is hereinafter described by way of example and by way of the attached figures. In these are shown in the drawings.

DETAILED DESCRIPTION OF THE INVENTION

Figure 3:
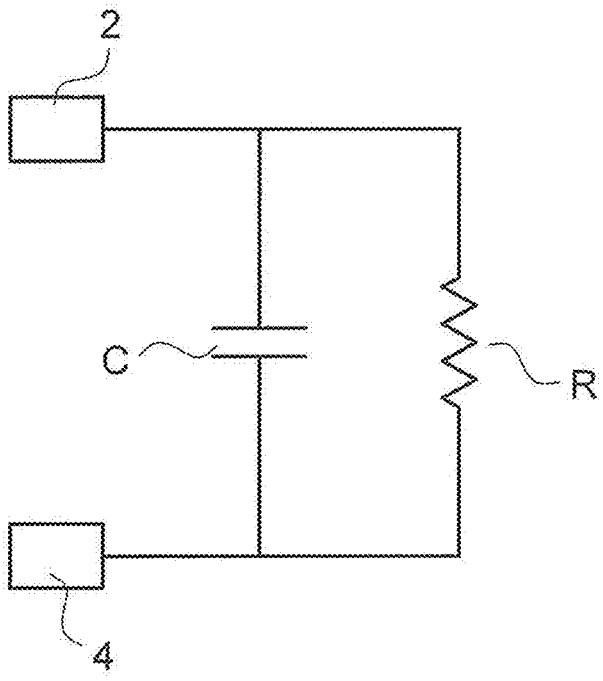
FIG. 3 is a model circuit diagram of two electrodes in the fluid to be delivered.

With regard to the sensor according to the invention, it is the case of a capacitive sensor, i.e. the switch-on and/or switch-off point in time for a pump are determined on the basis of a changing capacitance between the electrodes 2 and 4. For this, the electrodes 2 and 4 are arranged distanced to one another and electrically insulated to one another, such that the fluid to be delivered, whose fluid level is to be detected, influences the capacitance of the capacitor formed by the electrodes 2 and 4. This is effected in that, in the case in which fluid, for example water, is located between the electrodes 2 and 4, the capacitance is significantly changed compared to a condition, in which air is located between the two electrodes 2 and 4. This results from the greatly different permittivity of water and air. FIG. 3 shows a model circuit diagram or an equivalent circuit diagram for the arrangement of the electrodes 2 and 4 in the environment, in which either air or the fluid to be delivered is located. In particular, if with regard to the fluid to be delivered, it is the case of water which comes into contact with the two electrodes 2 and 4, the arrangement of the electrodes 2 and 4 does not act like an ideal capacitor. This is taken into account in the equivalent circuit diagram according to FIG. 3 and there, an electrical resistance R is represented parallel to the capacitance C. Thereby, it is the case the electrical resistance R of the medium between the electrodes 2 and 4. If air is between the electrodes 2 and 4, then this is very large. If water is located between the electrodes 2 and 4, then this resistance R may be very small.

A detection of the fluid only by way of the electrical resistance however is problematic, since even a thin film of water on the housing or the sensor arrangement, or for example a wet piece of paper which covers both electrodes, would reduce the resistance just as if the fluid level were to rise correspondingly high. The capacitance is however not influenced by such short circuits.

The measurement or detection of the capacitance between the electrodes 2 and 4 is carried out in a manner such that firstly the electrodes 2 and 4 are slowly charged with a low current. For this, a charge may be deposited onto one of the electrodes 2, 4. Preferably, the charging is effected by way of several very short voltage pulses. This has the advantage that no or only a small current flow occurs between the electrodes 2 and 4, so that an electrolysis between the electrodes 2 and 4, which could lead to a damage of the electrodes, is avoided.

Figure 1:
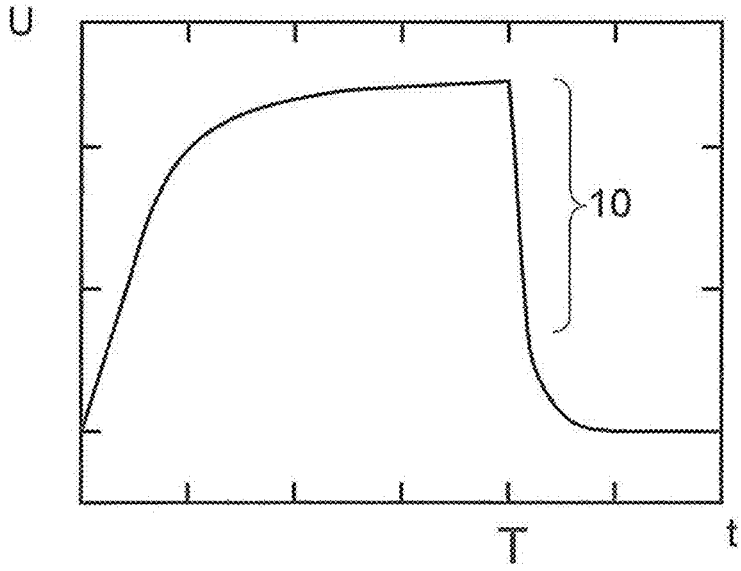
FIG. 1 is the voltage course on discharging the sensor.
Figure 2:
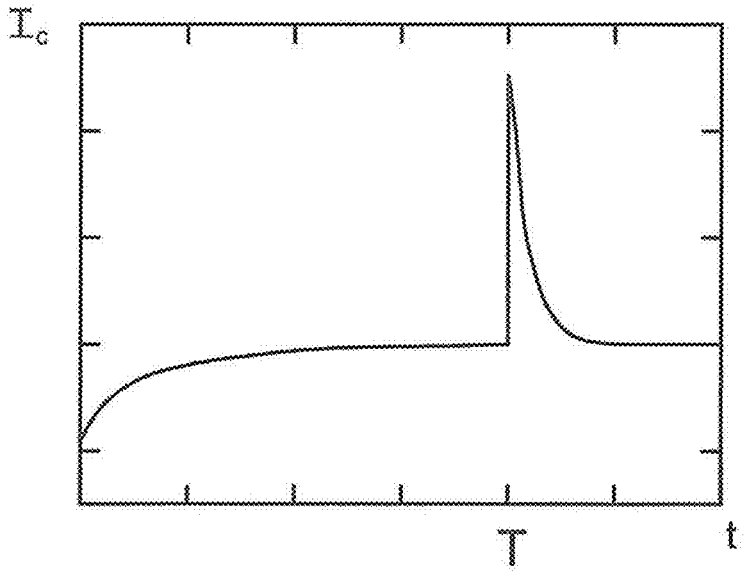
FIG. 2 is the current course on discharging the sensor.

The voltage course on charging is represented in FIG. 1. The charging procedure is effected up to the point in time T, at which the maximal charging is reached. As is to be recognized in FIG. 2, this is effected with a low charging current I. At the point in time T, the capacitor C formed by the two electrodes 2 and 4 is very rapidly discharged, i.e. the voltage drops steeply, as is shown in FIG. 1. This leads to a high discharge current, as is shown in FIG. 2. This discharge current is measured during the discharging procedure. The magnitude of the discharge current is proportional to the capacitance C between the electrodes 2 and 4.

What is essential with the discharge procedure is that the discharging of the electrodes 2 and 4 is effected with a defined, predefined very steep voltage course. As is to be recognized in FIG. 1, the gradient of the voltage course dU/dt is constant in the region 10. Moreover, this gradient is predefined and is set by the electronic circuit on discharging. Then, with the knowledge of this gradient, one may compute the capacitance C based in the relation $I_c = C \cdot dU/dt$ and on the basis of the measured discharge current $I_C$. The advantage of this measurement principle is that it may be realized in a very simple and inexpensive manner, since one may make do without expensive frequency generators.

Figure 4:
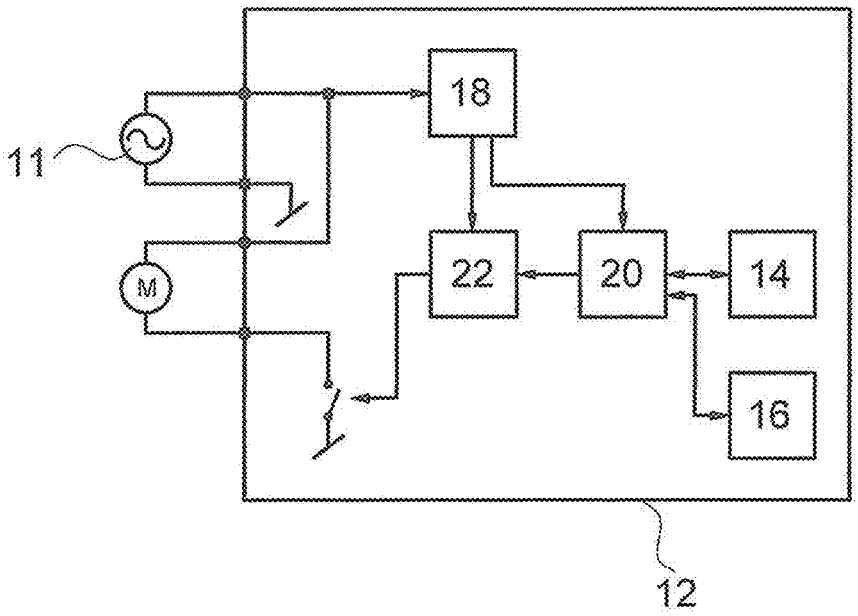
FIG. 4 is a block circuit diagram of a pump with a sensor according to the invention.

FIG. 4 schematically shows a block circuit diagram of a pump assembly according to the invention, with a sensor which operates according to the previously outlined measurement principle. The pump assembly has an electricity supply 11, e.g. in the form of a connection plug for connection to the electricity mains, as well as an electrical drive motor M and a control device 12 which is responsible for switching the drive motor on and/or off. In the shown example, two sensors 14 and 16 are provided, which in each case comprise two electrodes 2, 4 as previously described. A sensor 14 is provided for switching on the pump, the second sensor 16 is provided for switching off the pump. For this, the sensors 14 and 16 are arranged at positions which are vertically distanced to one another. The pump is switched on when the fluid level reaches the sensor 14, i.e. the upper sensor. The pump or the drive motor M is switched off when the fluid level falls below the lower sensor 16, and the lower sensor 16 thus detects air between the electrodes 2 and 4.

The control device 12 comprises an energy supply 18 for the control device 12, a controller 20 as well as a power switch 22. The controller 20 controls the charging and discharging of the electrodes 24 of the sensors 14 and 16 in the manner described previously, as well as the current measurement, and assumes the evaluation on discharging. If the electronic circuit detects a condition in which the motor is to be switched on or off, the power switch 22 for switching the motor on and off is activated accordingly by the controller. The controller 20 preferably carries out a continuous monitoring process, with which the electrodes of the sensors 14 and 16 are periodically charged and subsequently discharged again, wherein the described current measurement for detecting the capacitance is carried out with each discharging procedure. It is conceivable for the discharging cycle and the next charging cycle to be temporally spaced from one another. This temporal interval should however not be selected to be too long, in order to be able to detect the reaching of the switch-on level and switch-off level of the fluid, where possible in a real-time manner. This is particularly important when switching off, in order to avoid a longer dry running of the pump.

Figure 5:
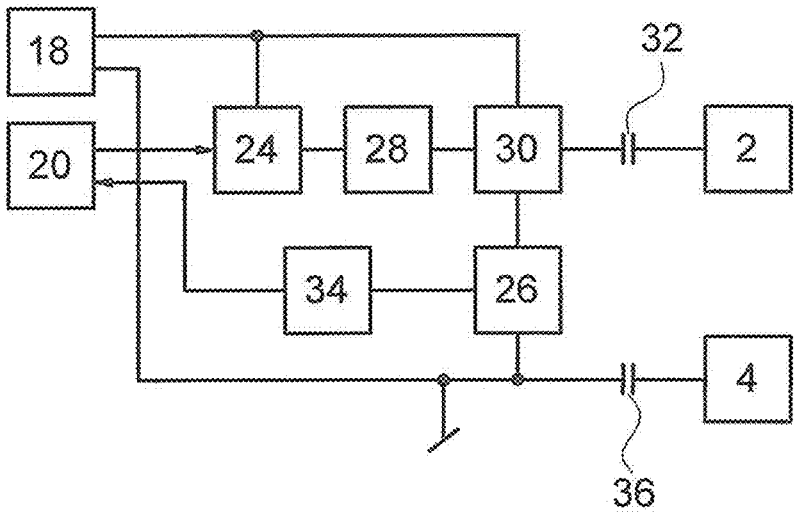
FIG. 5 is a block circuit diagram of a sensor according to the invention.

FIG. 5 is a block diagram which shows the schematic construction of a sensor device with sensor electrodes 2 and 4, as well as the associated control and evaluation circuit, which is now described in more detail. Apart from the energy supply 18 and the controller 20, which assumes the total operation of the sensor arrangement and the evaluation of the sensor signals, the electronic circuit as further essential components comprises a pulse generator 24 and a current sensor 26. The pulse former 28 as well as an output stage 30 connect on the output side of the pulse generator 24. The output stage 30 serves for buffering the signal, in order to also be able to recognize highly conductive fluids with the sensor according to the invention. The end-stage 30 is connected via a capacitor 32 to the first electrode 2. The pulse generator for charging the electrode 2 produces a plurality or multitude of very short voltage pulses, with which the sensor electrode is charged. For discharging, the pulse generator 24 together with the pulse former 28 produces the above-described, steep, predefined discharge curve. On discharging, the current sensor 26 detects the discharge current between the electrodes 2 and 4. The output signal of the current sensor 26 is led to a scanning and hold circuit 34, which stores the peak value of the discharge current and emits a proportional voltage as an output signal. This output signal is led to the microcontroller 20, which from this, and with the knowledge of the discharge curve, determines the capacitance between the electrodes 2 and 4 and carries out an evaluation as to whether air or water is located between the electrodes 2 and 4. The microcontroller 20 also activates the pulse generator 24 and sets the charging and discharging cycles.

The electrode 4 is also coupled via a capacitor 36. The coupling of the electrodes 2 and 4 via capacitors 32 and 36 insulates the electrodes 2, 4 with respect to electronics, so that a direct contact of a person with the electrodes 2 and 4 is not dangerous.

Figure 6:
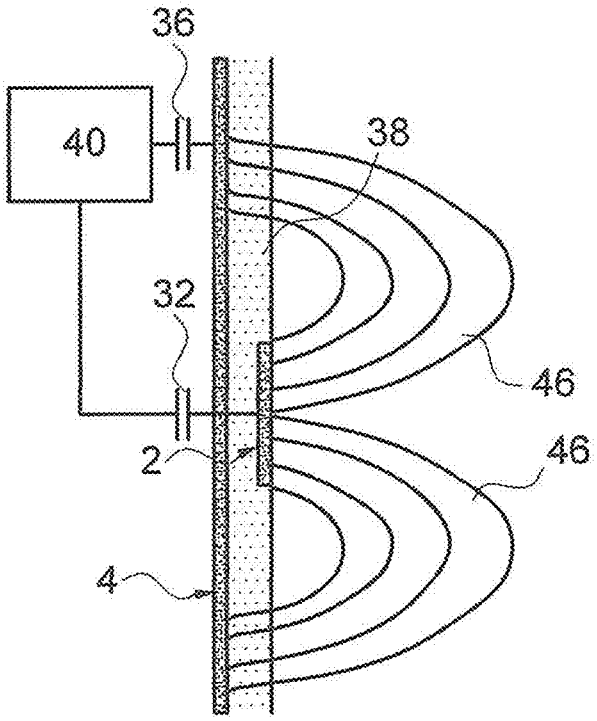
FIG. 6 is schematically, the arrangement of a sensor electrode on the housing of the pump.

FIG. 6 shows one possible arrangement of the electrodes 2 and 4 in the pump assembly. In this example, the electrode 4 is formed by the metallic pump housing and/or motor housing. The electrode 2 is arranged separately and is connected to the housing 4 via an insulator 38, so that the electrodes 2 and 4 are electrically insulated with respect to one another. As previously described, the electrodes 2 and 4 are connected via capacitors 32 and 36 to evaluation electronics 40. The evaluation electronics 40, as explained by way of FIG. 5, comprise the energy supply 18, the controller 20, pulse generator 24, current sensor 26, pulse former 28, output stage 30 as well as scanning and hold circuit 34. The evaluation electronics 40 may however also be designed differently in another suitable manner, for realizing the measurement principle according to the invention.

Figure 7:
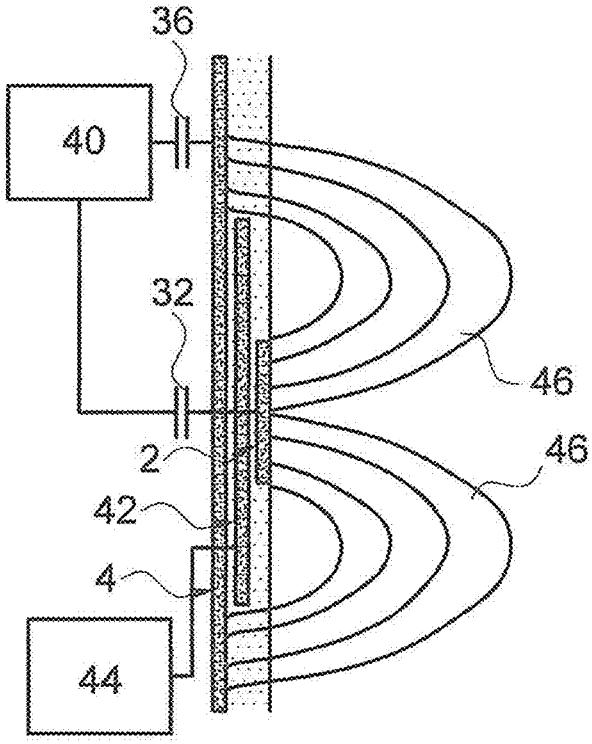
FIG. 7 is schematically, the arrangement of a sensor electrode in the housing of a pump, whilst using a protective electrode.

FIG. 7 shows a further possible arrangement of the electrodes 2 and 4 in the pump assembly, which corresponds essentially to the arrangement in FIG. 6. Additionally, here a protective electrode 42 is arranged between the housing which forms the second electrode 4, and the first electrode 2. The protective electrode 42 is connected to an active protective circuit 44. The protective electrode 42 and protective circuit 44 serve for shielding the electrode 2 from electrical fields which occur on the rear side of the electrode 2 in the inside of the housing by way of the electrical and electronic components which are arranged there, so that the electrode 2 only detects electrical fields outside the housing, as is indicated by the field lines 46.

Figure 8:
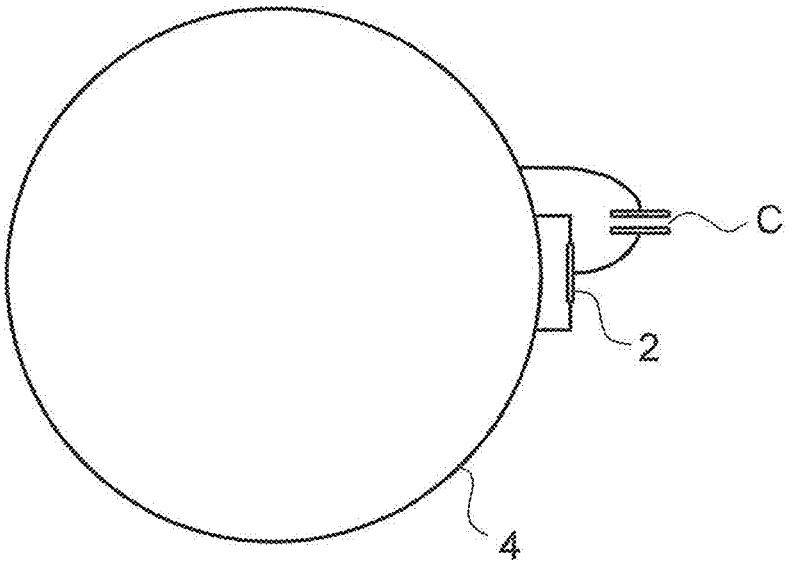
FIG. 8 is schematically, the arrangement of a sensor electrode on the pump housing.

FIG. 8 once again in a schematic plan view shows the pump assembly, whose housing serves as a second electrode 4. The first electrode is arranged in an electrically insulated manner with respect to the housing and thus to the second electrode, so that a capacitance C dependent on the surrounding medium or fluid is present between the electrodes 2 and 4.

Figure 9:
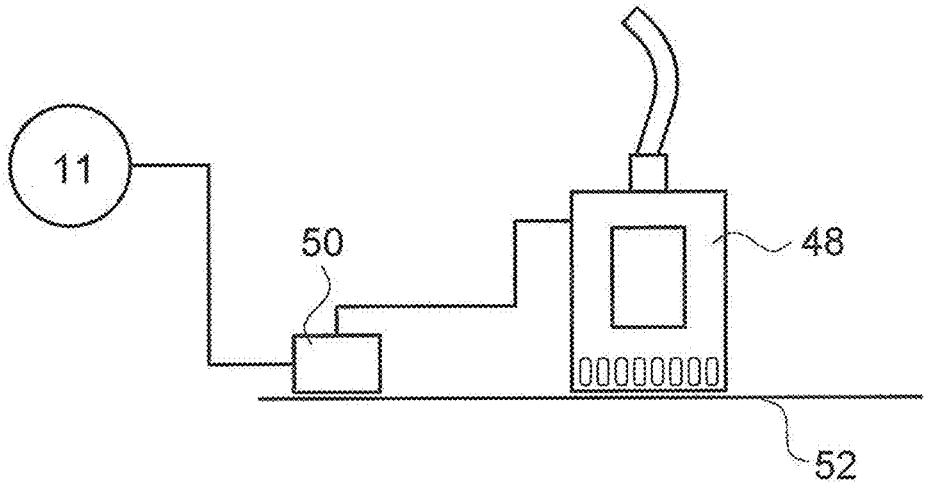
FIG. 9 is schematically, an arrangement of a pump with a sensor according to the invention.
Figure 10:
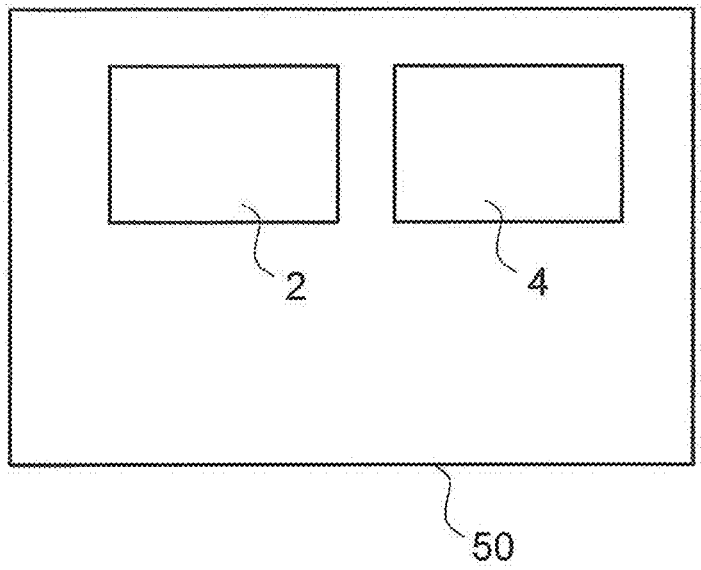
FIG. 10 is schematically, the arrangement of a pump with a sensor according to the invention, according to a further embodiment.

FIG. 9 shows one possible arrangement of a pump 48 with a sensor 50 which is constructed as described in FIG. 5. This sensor 50 here is not integrated into the pump assembly 48, but in the electrical supply lead between the electricity supply 11 and the pump assembly 48. The sensor 50, as shown in FIG. 10, comprises two sensor electrodes 2 and 4, which form a capacitor with the surroundings in the previously described manner. The sensor 50 is situated in the vicinity of the base 52. If the water level or fluid level rises so high, that the electrodes 2 and 4 of the sensor 50 lie in water, this is detected by the sensor and it switches the current supply for the pump 48 on, so that this delivers fluid or water. If the fluid level sinks below the level of the sensor electrodes 2 and 4, then the capacitance of the electrodes 2 and 4 changes significantly, which is detected in the previously described manner, and the sensor 50 then, via a power switch, interrupts the lead between the electricity supply 11 and the pump assembly 48, and thus switches off the pump assembly.

Figure 11:
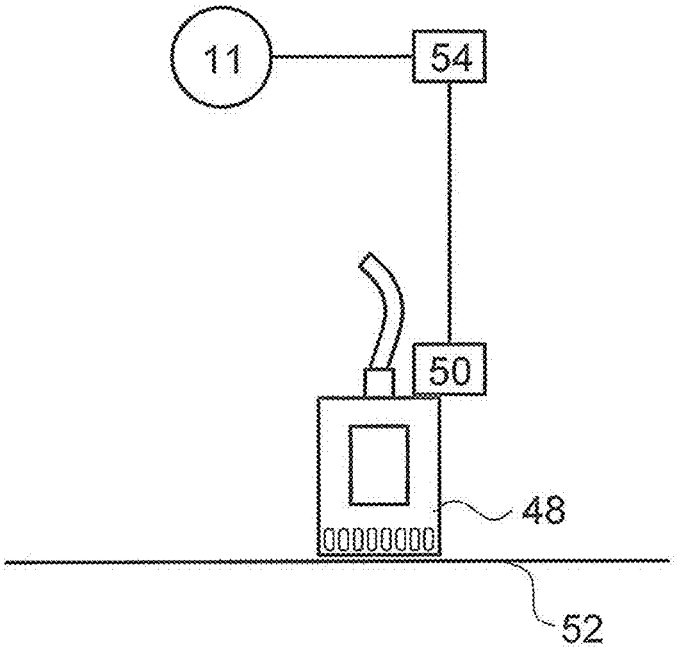
FIG. 11 is an arrangement similar to the arrangement in FIG. 9, with two sensors.

FIG. 11 shows an arrangement similar to the arrangement in FIG. 9, with the difference that two sensors 50 and 54 are provided. With two sensors 50 and 54, the pump assembly 48 is operated in the manner such that the pump 48 is switched on when the fluid level reaches the upper sensor 54 and thus its electrodes 2 and 4 lie in fluid. The pump assembly 48 is switched off when the lower sensor 50 detects air between its electrodes 2 and 4, i.e. the fluid level has sunk to below the vertical level of the sensor 50.

The switching-off of the pump may, according to the invention, also be initiated in another manner. For example the motor control for the pump motor may detect the dry running of the pump. This may be recognized from electrical parameters of the motor, for example by way of a phase shift of the supply voltage.

Figure 12:
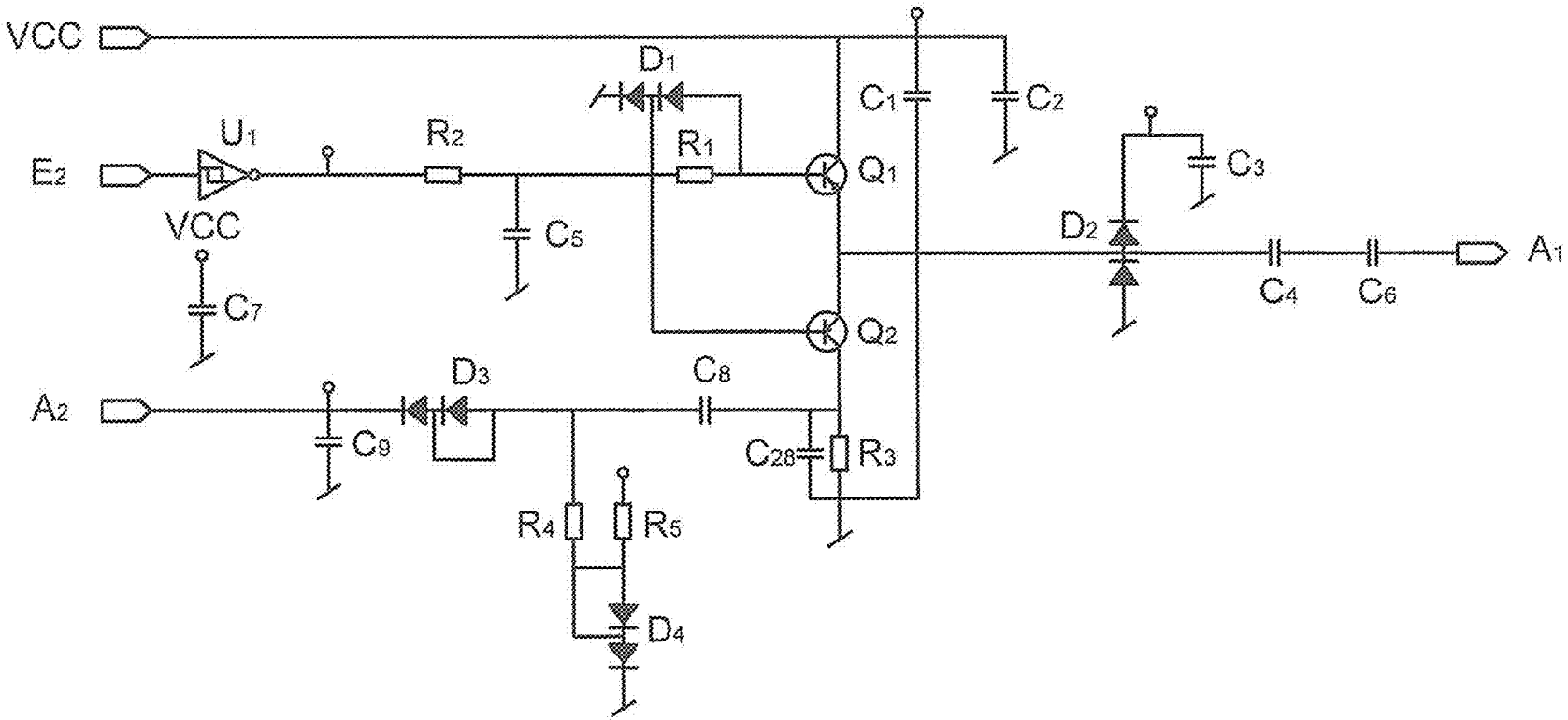
FIG. 12 is an exemplary construction of the sensor electronics.

An exemplary circuit plan of the sensor electronics, whose essential components are described hereinafter, is represented in FIG. 12. VCC is the input voltage for the capacitive sensor. $C_1$ is a bypass capacitor and $C_2$ is that capacitor which is charged, in order to provide a certain energy quantity for the sensor. If the sensor is activated, the voltage supply VCC is interrupted and the sensor electrodes 2, 4 are supplied via the output $A_1$ alone with the voltage from the capacitor $C_2$. The energy stored in the capacitor $C_2$ is thereby released by the capacitance or the conductivity of the water. As a result, a residual energy quantity remains in the capacitor $C_2$ at the end of the measurement, so that the conductivity of the water may be determined by way of the remaining voltage across the capacitor $C_2$.

U1 is a pulse former in the form of a Schmitt-trigger. The pulses for activating the sensor are led to the pulse former U1 via the input $E_2$, which represents the input of the Schmitt-trigger.

The discharge curve or discharge speed dU/dt for the sensor is set by way of the resistance $R_2$ and the capacitor $C_5$. The transistors $Q_1$ and $Q_2$ serve for providing a greater current to the sensor output $A_1$. The diode $D_1$ and the resistance $R_1$ serve for the protection of the transistor $Q_1$ and reduce the charging speed dU/dt. The capacitors $C_4$ and $C_6$ are separating capacitors which serve for the protection of persons who come into contact with the electrodes 2, 4.

The resistance $R_3$ serves for detecting the current which here flows between the electrodes 2, 4 and earth, i.e. this is the current which is proportional to the capacitance between the sensor electrodes 2, 4, which is to be measured.

The capacitor $C_8$ is a decoupling capacitor which permits the peak value detector formed from the diode $D_3$ and capacitor $C_9$, in combination with the biasing circuit formed from the resistors $R_4$ and $R_5$ and the diode $D_4$, to have an offset error close to zero.

The capacitor $C_9$ serves for holding the voltage corresponding to the detected capacitance and for carrying out a slow digitalization of the voltage via for example an analog-digital converter at the output $A_2$.

The capacitor $C_{28}$ serves for correcting disturbances or disturbance oscillations.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A sensor for switching a pump on and/or off, with at least one first and a second electrode, which form a capacitance which may be influenced by way of a fluid to be delivered, and with evaluation electronics connected to the electrodes, characterized in that the evaluation electronics has a voltage supply which is connected to the first electrode and which is designed for providing short voltage pulses for charging the first electrode, and comprises an evaluation circuit which is designed in a manner such that during a voltage increase on charging and/or a voltage reduction on discharging the electrode, the evaluation circuit detects a current between the electrodes and emits a switch-on signal and/or switch-off signal depending on the detected current.

2. A sensor according to claim 1, characterized in that the electronic circuit is designed in a manner such that on charging the electrode and/or on discharging the electrode, the temporal signal course of the voltage has a predefined gradient at least in one section.

3. A sensor according to claim 2, characterized in that the predefined gradient is selected steeply, preferably steeper than 5 V/μs.

4. A sensor according to claim 1, characterized in that the evaluation electronics is designed in a manner such that a cyclically repeating charging and discharging of the electrode takes place with the detection of the current on charging and/or discharging.

5. A sensor according to claim 1, characterized in that the evaluation electronics is designed in a manner such that the evaluation circuit additionally determines the electrical resistance between the two electrodes and emits a switch-on signal and/or switch-off signal depending on the detected current and the resistance.

6. A sensor according to claim 1, characterized in that the voltage supply has a voltage source with a resistance connected in series with the voltage supply and with a capacitance connected in parallel to the voltage supply.

7. A sensor according to claim 1, characterized in that the voltage supply comprises a signal generator for producing a charging voltage and/or discharge voltage with a defined signal course.

8. A sensor according to claim 1, characterized in that the at least one first and second electrode are outside the pump.

9. A sensor for switching a pump on and/or off, with at least one first electrode and one second electrode, which form a capacitance which may be influenced by way of a fluid to be delivered, and with evaluation electronics connected to the electrodes, characterized in that the evaluation electronics has a voltage supply which is connected to the first electrode and which is designed for providing short voltage pulses for charging the first electrode and is designed in a manner such that the electrode is firstly charged by several voltage pulses of the voltage supply and subsequently discharged, and comprises an evaluation circuit which is designed in a manner such that during a voltage increase on charging and/or a voltage reduction on discharging the electrode, the evaluation circuit detects a current between the electrodes and emits a switch-on signal and/or switch-off signal depending on the detected current, wherein the evaluation circuit detects the current during the discharge and emits a switch-on signal and/or switch-off signal depending on the detected current.

10. A pump for delivering a fluid with an electrical drive motor and with a control device for switching the drive motor on and off, characterised in that the control device comprises at least one sensor according to claim 1, for switching the pump on and/or off in dependence on the fluid level.

11. A pump according to claim 10, characterized in that one of the electrodes is formed by the housing of the pump and the second electrode is arranged insulated with respect to the housing.

12. A pump according to claim 10, characterized in that the sensor is arranged in order to produce a switch-on signal for the drive motor given a predefined fluid level.

13. A pump according to claim 10, characterized in that a switch-off device for the pump is provided, which comprises at least one detection means for detecting at least one electrical parameter of the drive motor and which is designed in a manner such that a dry running of the pump may be detected on the basis of this electrical parameter, and a switch-off signal for the drive motor is produced with a detected dry-running.

14. A pump according to claim 10, characterized in that a protective electrode is arranged, which shields the first electrode of the sensor with respect to the electrical components in the inside of the pump.

15. A sensor for switching on and off a pump for pumping a fluid through a pumping chamber, the sensor comprising:

at least one first electrode and one second electrode forming a capacitance influenceable by the fluid before the fluid enters the pumping chamber;

evaluation electronics connected to the electrodes, the evaluation electronics comprising:

a voltage supply connected to the first electrode and providing short voltage pulses charging the first electrode, and an evaluation circuit which detects a current between the first and second electrodes and emits a switch-on signal and/or a switch-off signal depending on the detected current, during a voltage increase on charging the electrodes or a voltage reduction on discharging the electrodes.

* * * * *